United States Patent [19]

Ferragni et al.

[11] Patent Number: 4,795,392

[45] Date of Patent: Jan. 3, 1989

[54] METHOD FOR SEALING VACUUM TUBE TIPS ESPECIALLY CATHODE TUBE TIPS, AND MACHINE FOR APPLYING THIS METHOD

[75] Inventors: Clemente Ferragni, Frosinone; Enzo Miccinatti, Carpineto, both of Italy

[73] Assignee: Videocolor, Montrou, France

[21] Appl. No.: 61,471

[22] Filed: Jun. 15, 1987

[30] Foreign Application Priority Data

Jun. 16, 1986 [FR] France ..... 86 08650

[51] Int. Cl.[4] ..... H01J 9/40

[52] U.S. Cl. ..... 445/43; 445/70; 445/71; 65/162; 65/270; 65/34; 364/477

[58] Field of Search ..... 445/43, 63, 70, 71; 65/162, 270, 34; 364/473, 477

[56] References Cited

U.S. PATENT DOCUMENTS 4,626,269 12/1986 Halgas ..... 65/270 X

FOREIGN PATENT DOCUMENTS 1057886 3/1954 France .
854305 11/1960 United Kingdom .

OTHER PUBLICATIONS

Patents Abstracts of Japan, vol. 7, No. 186 (E-193), [1331], Aug. 16, 1983; & JP-A-58 89 759 (Hitachi Seisakusho K.K.), 5-28-1983.

*Primary Examiner*—Kenneth J. Ramsey
*Attorney, Agent, or Firm*—Oblon, Fisher, Spivak, McClelland & Maier

[57] ABSTRACT

For sure sealing of the evacuation tips of vacuum tubes, the electric power supplied to the heating resistor of the sealing furnace is regulated for each treatment stage, the set value is pre-selected and laid down by a computer for the corresponding power generator.

5 Claims, 1 Drawing Sheet

POWER GENERATOR
0-700W
C.N.A
0-20mA
ADDRESS COUNTER
RAM (P)
CPU
TIMER
RAZ
INH
I/O
1
2
3
4
5
6
7
8
9
10
13
14
15
16
17
18

STATION N°
P%
99
90
80
70
60
50
40
30
20
10
0
1
2
3
4
5
6
7
8
9
10
11
12
PRE-HEATING
MELTING
ANNEALING

METHOD FOR SEALING VACUUM TUBE TIPS ESPECIALLY CATHODE TUBE TIPS, AND MACHINE FOR APPLYING THIS METHOD

BACKGROUND OF THE INVENTION

1. Field of the Invention

The object of the present invention is a method for sealing vacuum tube tips (also known as stems), especially the tips of cathode tubes, and a machine for applying this method.

2. Description of the Prior Art

To seal the evacuation tips of vacuum tubes, first an adequate vacuum is made in the tube, then this tip is heated to melting point by means of a heating resistor that surrounds it at a small distance away, set in a refractory chamber forming a sort of furnace around this tip. The heating operations generally comprise three main stages: pre-heating, melting and annealing. These stages are executed at different successive stations along the path followed by the trolleys that carry the tubes and the device that heats their tips after these tubes are removed. At each station where the trolleys stop, the heating devices of these trolleys receive a certain amount of electrical power given by a generator through a set of sliding contacts. The value of this power depends on the temperature reached by the tips, this temperature being determined beforehand, according to a established process in which a standard quartz tip is used.

This method used in the prior art has two main disadvantages: because of the variations in the value of the resistance of the sliding contacts and the resistance of the current lead-in wires for the various heat treatment stations, as well as variations in the heating resistor itself because of its ageing, it is not possible to guarantee the requisite heating temperature for each station, and this creates the risk of breakage or embrittlement of the tip after sealing, owing to the poor coordination of the heating temperatures at the various stations. Furthermore, if for any reason, the trolleys stop for longer than planned at their respective stations, there could be a loss of synchronization between the real position of the trolleys and the heat treatment stages, leading to loss of control over the pre-set process.

3. Summary of the Invention

The object of the present invention is a method to seal evacuation tips, a method that guarantees the desired heating temperature at each station even when the trolleys stop for longer than is necessary at a treatment station.

The method for sealing evacuation tips according to the invention consists in regulating the heating power sent to the tip-heating device for each heating stage, at a constant set value.

The device according to the invention, inserted in a vacuum tube production line, especially a cathode tube production line, downstream of the machines that evacuate the tubes and treat them before they are sealed, comprises an energy supply device that works, together with tube-carrying trolleys fitted with appropriate tip-heating devices, at several treatment stations, for example by means of current distribution rails. This energy supply device comprises a regulated power supply source, controlled by a computer device that lays down a pre-determined set power value on each station.

According to an advantageous feature of the invention, the computer device works together with means to detect any prolonged stopping of the tubes at treatment stations and means that change the set power value at any station where the stopping time of a tube has exceeded a determined value to the following set value.

BRIEF DESCRIPTION OF THE DRAWINGS

The present invention will be better understood from the following detailed description of an embodiment, taken as a non-exhaustive example, and illustrated by the appended drawing of which.

DESCRIPTION OF THE PREFERRED EMBODIMENT

The present invention is described below with reference to the manufacture of television cathode tubes, and especially with reference to the phase in which their evacuation tips are sealed, but it is understood that the said invention can be applied to the manufacture of all other types of vacuum tubes for which the evacuation tip has to be sealed by heating using an appropriate electrical furnace.

Generally, the stage for sealing evacuation tips is conducted by means of tube-carrying trolleys which all move along the same path. At the beginning of this path, the tubes are loaded on to the trolleys and then go to various successive working stations where they are heat-treated and then pumped out. When the vacuum created inside the tubes is sufficient, the trolleys go to several other treatment stations where the various steps for the sealing of their tips are performed.

Figure 1:
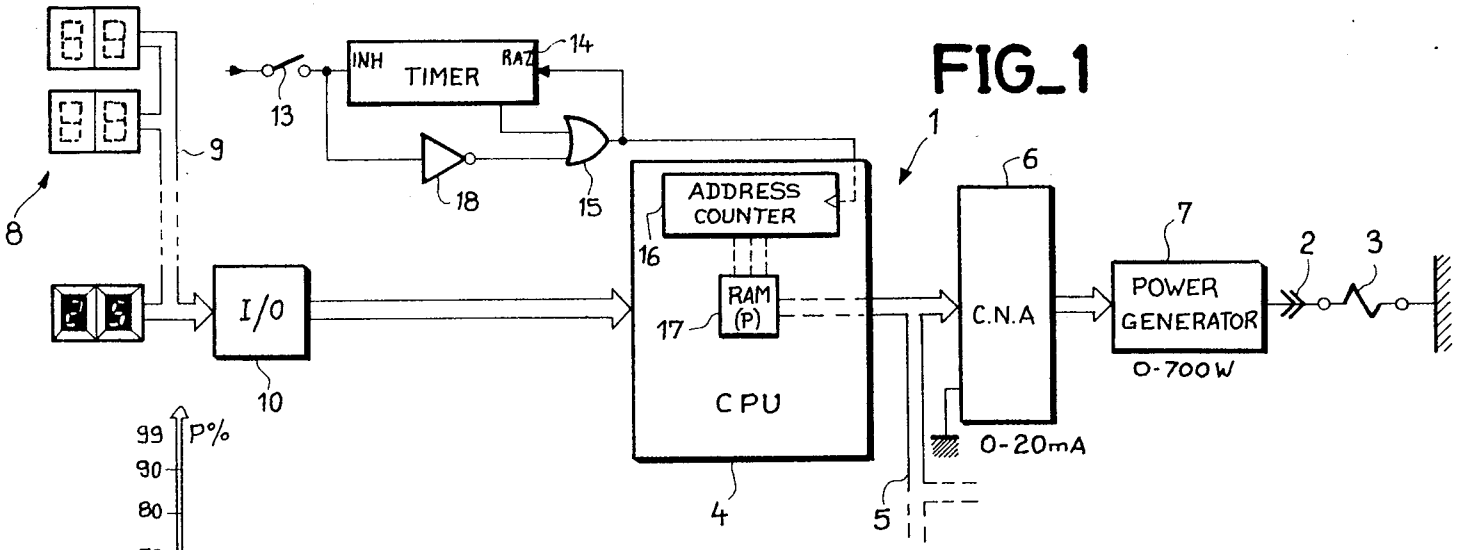
FIG. 1 is a block diagram of an energy supply device according to the invention.

There are generally eight to twelve of these steps. The sealing is done by means of a small, ring-shaped electrical furnace, which is placed beforehand around the tip at the sealing level. This furnace is powered with electrical energy by means of sliding contacts which are arranged on the trolley and rub against fixed electrical rails. These rails are supplied with energy by a device described below with reference to FIG. 1.

By means of a sliding contact 2, the energy supply device 1 powers the heating resistor 3 of a tip-sealing furnace (not shown). To make the drawing clearer, only one of the sliding contacts and only one heating resistor has been shown.

The device 1 comprises a computer 4 with its output bus 5 connected to as many interfaces 6 as there are sealing stations. Only one of these interfaces has been shown on the drawings.

The interface is a digital/analog converter that gives a control current, varying for example between 0 and 20 mA, to a power supply unit 7. The power supply unit 7 gives, for example, a power varying fom 0 to 700 W when its control current, given by the circuits 6, varies from 0 to 20 mA. The power supply unit 7 supplies energy to the corresponding resistor 3 through the rail 2.

Pre-selecting devices 8, equal in number to the sealing stations, are connected to a bus 9, which is itself connected by an appropriate input/output interface 10 to the computer 4. The devices 8 may, for example, be encoded wheels with a manual selection system, used to adjust the set value of the power that should be sent by the corresponding power supply unit 7 to its heating resistor. The set value pre-selected by such pre-selecting device may advantageously be a percentage of the maximum power delivered by the corresponding power supply unit 7 (the power supply units 7 are all identical). In the embodiment described herein, the tips are sealed in twelve steps of the same duration, each of these twelve steps being normally executed at a corresponding treatment station. Since these steps all have the same duration and since, at each step, the heating power given to the corresponding resistor 3 is regulated by the computer 4 at the set value chosen by the corresponding pre-selection device, an appropriate heating power instead of a temperature can be determined for each treating station.

Figure 2:
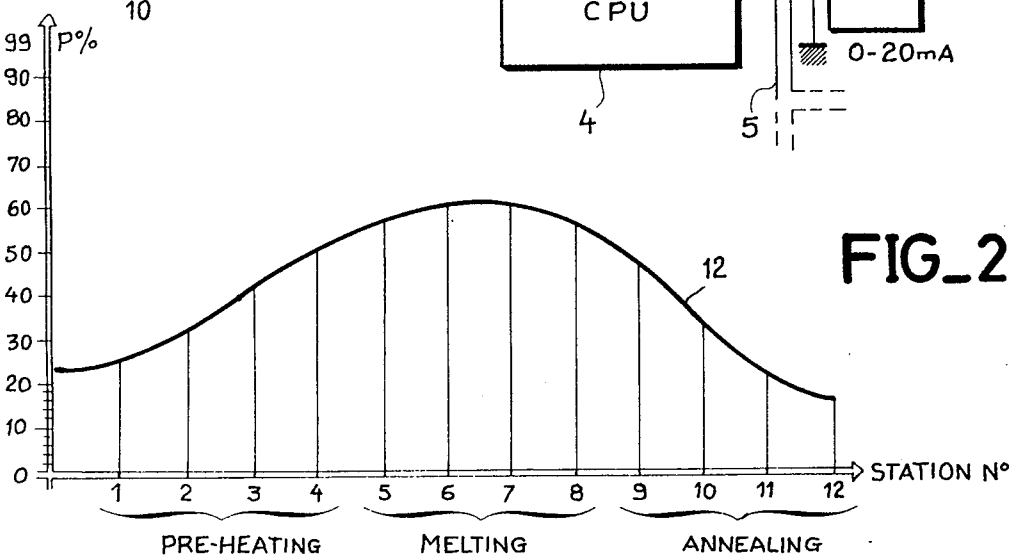
FIG. 2 is a typical diagram of the levels of power given by the device of FIG. 1 to the various treatment stations for a tip-sealing device.

As shown in the graph of FIG. 2, the sealing process is performed in three consecutive parts, namely the pre-heating, the melting and the annealing parts respectively, and each of these parts comprises four steps. Since, just before sealing, the cathode tubes undergo heat treatment, the temperature laid down for the first heating station is set at a value equal to or slightly greater than that of the tubes, and more especially that of their tips, upon arrival at this station. For the example shown in FIG. 2, this temperature corresponds to about 22% of the maximum power given by the generator 7. After this, the power sent to the resistor 3 is increased in small stages up to a maximum value, at the stations 6 and 7, of about 60% of the maximum value, and then this power is diminished and reaches, at the station 12, a value slightly lower than that laid down for the station 1. The continuous curve 12, which is the envelope of the power values laid down for the different stations, appreciably corresponds to the development of the temperature of the tip during this sealing stage, but it is understood that, at each station, the power is regulated at an unchanging set value. The values of the temperature at each station are, of course, known values. They are the values that would be sought with machines of the prior art where they are controlled with difficulty as described above, but are obtained easily and with certainty through the method of the present invention. The various power values needed to obtain these temperatures are determined by successive trials, in a manner evident to the specialist.

According to an advantageous characteristic of the invention, each station of the sealing machine comprises a contactor 13 which is actuated when a trolley arrives at this station. This contactor 13 is connected to the inhibiting input of a timer 14 made with a digital counter. The contactor 13 is mounted so as to inhibit the timer 14 when there is no trolley at the corresponding station, and to validate it as soon as a trolley is in position at this station. Let T be the maximum time for which a trolley must remain at a station (for example, T=30 seconds, this time being the same for all the stations). The status output corresponding to the time T of the timer 14 is connected through an OR circuit 15 to the clock input of a counter 16 that addresses the RAM 17 of the computer 4, as well as to the zeroizing input RAZ of the timer. The contactor 13 is also connected, through a logic inverter 18, to another input of the OR circuit 15 in such a way as to send a clock pulse to the counter 16 when a trolley reaches the station. The RAM 17 contains the various set power values of the sealing process which it sends to the bus 5, these various set values being, of course, appropriately shunted towards the corresponding converters 6. For the clearness of the drawing, only one timer 14, with its gates 15 and 18, has been shown. In a normal situation, when a trolley reaches a station, the corresponding contactor 13 validates the timer 14 (previously zeroized) which starts counting. Upon the arrival of a given trolley, the counter 16 addresses the RAM 17 so as to send the corresponding set value to each of the twelve converters 6. If the operation takes place smoothly, i.e. if at the end of the normal treatment time (smaller than T), the said trolley leaves the station and goes towards the following station, the contactor 13 trips and sends a clock pulse to the counter 16 through the gates 18 and 15, and this clock pulse shifts all the addresses relative to the RAM 17 by one unit, and the process continues as planned, the timer 14 being zeroized.

If the said trolley does not leave the said station at the end of the time T, the timer 14 sends a clock pulse to the counter 16 and is zeroized. This clock pulse modifies the addressing of the counter 16 as if the trolley in question had left its station, and we return to the previous situation. If, at the end of the time 2T, the said trolley has not yet left its station, the counter 16 receives a fresh clock pulse and its addressing is again shifted. This artificial shifting process can continue until the tube of the trolley of the first sealing station has undergone all twelve planned stages of treatment and if, after the twelfth stage, the said trolley is still blocked, the process is stopped. Of course, the elements 14, 15, 18 can be replaced by equivalent means, especially by means that form part of the computer 4.

What is claimed is:

1. Method for sealing the evacuation tips of vacuum tubes, especially cathode tubes, comprising several successive heating stages at heating stations which are laid out on the path of a production line, method wherein, for each heating stage, the heating power sent to the tip-heating device is regulated at a constant set value.

2. Method according to the claim 1 wherein, if a tube stops at a treatment station for longer than a specified time, the treatment stages of this tube and those of all the tubes that it prevents from moving forward are shifted.

3. Device for sealing the evacuation tips of vacuum tubes, especially cathode tubes, inserted in a production line, downstream of the machines that evacuate the tubes and treat them before sealing, this device comprising a power supply device that works, at several treatment stations, by means of current distribution rails for example, with tube-carrying trolleys fitted with appropriate tip-heating devices, device wherein the power supply device comprises a regulated power supply source controlled by a computer device that lays down a pre-determined set power value for each station.

4. Device according to the claim 3, wherein the computer device works with means that detect the prolonged stopping of tubes at the treatment stations and means that change the set power value, at any station where the stopping time exceeds a determined value, to the following set value.

5. Device according to the claim 4, wherein the said means for detecting prolonged stopping comprise a counter which is zeroized whenever a time equal to the said determined value has elapsed or as soon as a tube leaves the corresponding treatment station, and is inhibited for as long as a tube is not present at the corresponding treatment station.

* * * * *